US009237777B2

(12) United States Patent
Perotto

(10) Patent No.: US 9,237,777 B2
(45) Date of Patent: Jan. 19, 2016

(54) SERIES OF SKI BOOTS

(75) Inventor: Riccardo Perotto, Venegazzu (IT)

(73) Assignee: Rossignol Lange S.r.l., Montebelluna (IT)

( * ) Notice: Subject to any disclaimer, the term of this patent is extended or adjusted under 35 U.S.C. 154(b) by 440 days.

(21) Appl. No.: 12/896,648

(22) Filed: Oct. 1, 2010

(65) Prior Publication Data

US 2011/0078925 A1 Apr. 7, 2011

(30) Foreign Application Priority Data

Oct. 5, 2009 (EP) ..... 09425388

(51) Int. Cl.
*A43B 5/04* (2006.01)
*A43B 5/16* (2006.01)
*A43B 3/26* (2006.01)

(52) U.S. Cl.
CPC ..... *A43B 5/0435* (2013.01); *A43B 3/26* (2013.01); *A43B 5/0405* (2013.01); *A43B 5/0427* (2013.01); *A43B 5/0478* (2013.01)

(58) Field of Classification Search
CPC ..... A43B 3/26; A43B 5/0478; A43B 5/0435; A43B 5/0427; A43B 5/0405; A43B 5/0409
USPC ..... 36/97, 117.1, 119.6, 10, 55, 93, 88; D2/904
See application file for complete search history.

(56) References Cited

U.S. PATENT DOCUMENTS 2,343,477 A * 3/1944 Ross ..... 36/10
3,530,595 A * 9/1970 Vogel ..... A43B 5/04 36/117.6
3,906,646 A * 9/1975 Milotic ..... 36/100
3,936,959 A * 2/1976 Hanson et al. ..... 36/93
4,169,325 A * 10/1979 Salomon ..... 36/117.6
4,414,762 A * 11/1983 Salomon et al. ..... 36/117.1
4,706,316 A * 11/1987 Tanzi ..... 12/142 T
4,790,082 A * 12/1988 Pozzebon ..... 36/117.1
4,901,450 A * 2/1990 Chemello et al. ..... 36/10
4,949,479 A * 8/1990 Ottieri ..... 36/117.3
6,082,027 A * 7/2000 Wagonhurst ..... 36/97
D428,685 S * 8/2000 Parisotto ..... D2/904
6,112,435 A * 9/2000 Collavo ..... 36/117.1
6,226,898 B1 * 5/2001 Trimble et al. ..... 36/118.2
2001/0001908 A1 * 5/2001 Chemello ..... 36/117.1

(Continued)

FOREIGN PATENT DOCUMENTS

DE G 86 04 180.0 U 6/1987
EP 1 475 005 A 11/2004

(Continued)

OTHER PUBLICATIONS

Search Report issued by European Patent Office for priority application EP 09 42 5388 mailed Mar. 30, 2010.

*Primary Examiner* — Khoa Huynh
*Assistant Examiner* — Katharine Gracz
(74) *Attorney, Agent, or Firm* — Frommer Lawrence & Haug LLP

(57) ABSTRACT

A series of ski boots comprising at least two ski boots whose rigid outer shell (2) is identical, and in which at least one of the boots of the series of boots has a rigid shell (2) comprising an internally inserted slipper (20; 20'), the slipper (20; 20') comprising a bootboard (25; 25') and side walls (21; 21'), so that the at least two ski boots comprising an identical rigid outer shell (2) are of different sizes.

16 Claims, 6 Drawing Sheets

(56) References Cited

U.S. PATENT DOCUMENTS

| | | | | |
|---|---|---|---|---|
| 2004/0244221 | A1* | 12/2004 | Hall et al. | 36/10 |
| 2007/0151123 | A1* | 7/2007 | Cavasin | 36/10 |
| 2008/0184597 | A1* | 8/2008 | Dal Bello et al. | 36/97 |
| 2008/0196275 | A1 | 8/2008 | Brandt | |
| 2009/0000152 | A1* | 1/2009 | Agnew et al. | 36/118.1 |
| 2009/0307930 | A1* | 12/2009 | Perizzolo | 36/115 |

FOREIGN PATENT DOCUMENTS

| | | | |
|---|---|---|---|
| EP | 1 785 047 | A | 5/2007 |
| EP | 1 952 711 | A | 8/2008 |
| WO | WO 96/19127 | A | 6/1996 |

* cited by examiner

SERIES OF SKI BOOTS

This application claims priority benefits of European Patent Application Number 09425388.7 filed Oct. 5, 2009, the entire disclosure of which is incorporated herein by reference.

The invention relates to a series of ski boots and a method for making such a series.

BACKGROUND OF THE INVENTION

In the prior art, a ski boot is generally composed of a rigid shell, obtained by injection molding a plastic in a manufacturing mold, to which is attached a hinged plastic cuff, similarly obtained by injection molding and designed to cover the lower part of the leg. This assembly forms a ski boot upper made of plastic with a hardness of generally between 40 and 60 Shore D. The method of injection molding the shell and cuff requires very expensive manufacturing molds. The shell is designed to enclose the foot and corresponds to a given boot size. It comprises a rigid outer bootboard comprising standardized front and rear lips designed to engage with the jaws of a toepiece and a heelpiece, respectively, of a device for binding the boot to the ski. A "Zeppa" bootboard is generally built into the shell, followed by a comfort innerboot which usually contains an insole. It is known practice to provide a shell of a different size for each integer boot size—that is, the length of its bootboard, between the two lips, is different, and its overall dimensions are different to correspond to feet of different sizes, in accordance with standardized volumes according to the Mondopoint standard, for example. These shells therefore require a different manufacturing mold for each boot size. Next, it is known practice to provide two different half boot sizes for each shell by allowing two innerboots of slightly different volumes to be inserted or having two insoles of different thicknesses in the same shell, thus increasing the number of options for the skier. Next, the distance between the toepiece and heelpiece of the ski boot binding device is adjusted to the size of the outer bootboard of the ski boot for actual skiing.

This is a burdensome situation for the management of ski boots and skis, especially for ski equipment hire stores, which have to keep multiple series of ski boots in all sizes so that they can offer customers the right ski boot for their size. Next, when a customer has selected a boot, he or she needs a ski to fit: the heel-to-toe separation of the selected ski binding device rarely corresponds to the selected ski boot, because the previous hirer of the ski often had a different size of boot, which means the separation must be adjusted to fit it to the selected ski boot. Ski equipment hire stores thus have to undertake many adjustment operations, which takes up time and can lead to mistakes. They must also offer a series of boots in all integer and half sizes, which is a heavy investment.

To ameliorate this situation, document US2008196275 proposes a solution in which a series of boots extending from size 23 to size 34 uses only three different bootboards, that is to say three different lengths requiring only three different corresponding spacings between the front toepiece and the heelpiece of a device for binding a boot to a snowboard. This solution is therefore advantageous in that it greatly reduces the demands and the risk of error in setting up the ski boot binding device. To achieve this advantageous result, the solution proposes two boot shells of different sizes for each length of bootboard, making a total of six different shells. Each of these shells is then given two innerboots of different dimensions to produce two different boot sizes, which is how the desired twelve different boot sizes is achieved. The problem with this solution is that it requires six different manufacturing molds to produce the six different sizes of shells, so it is still expensive to purchase the complete series of boots. Also, innerboots compensate for the volumes of the shells to form two different sizes out of each boot shell: these inner boots must therefore have thick walls to form the small sizes, which is detrimental to the transmission of forces from the foot to the ski and reduces the overall performance of the boot.

Document EP1952711 proposes an alternative solution by a similar approach in which a series of boots can be used to create twelve boot sizes from four different bootboard lengths, and three different shells for each length of bootboard. This solution suffers from the same problem as the previous solution because it inevitably requires twelve different molds to produce twelve different shells.

Consequently, the prior art solutions allow the number of possible combinations of bootboard length to be reduced in order to reduce the necessary adjustments of the ski boot binding devices. However, they still require a heavy investment for the purchase of the complete series of boots to cover all boot sizes.

There is therefore a need for another solution that reduces the investment cost of obtaining a series of ski boots.

SUMMARY OF THE INVENTION

The concept of the invention provides an inner slipper that comprises a sole and side walls and can be integrated into a conventional rigid shell of a ski boot to reduce the boot size defined by this rigid shell.

The invention is defined more precisely in the claims.

DESCRIPTION OF THE DRAWINGS

These objects, features and advantages of the present invention will be set forth in detail in the following description of one particular embodiment presented without implying any limitation, with reference to the accompanying figures, of which.

Figure 1:
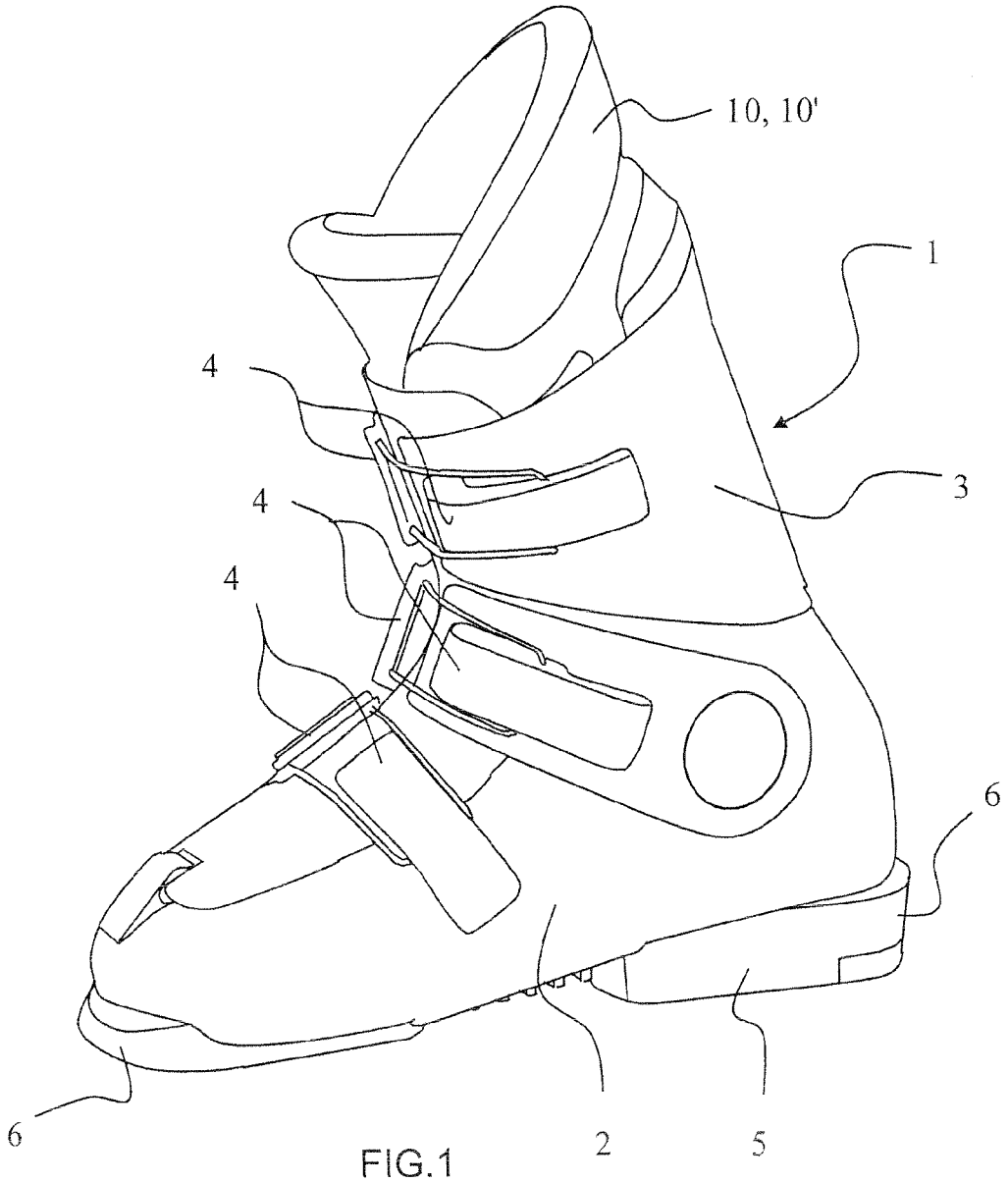
FIG. 1 is a side view in perspective of a ski boot of the invention.
Figure 2:
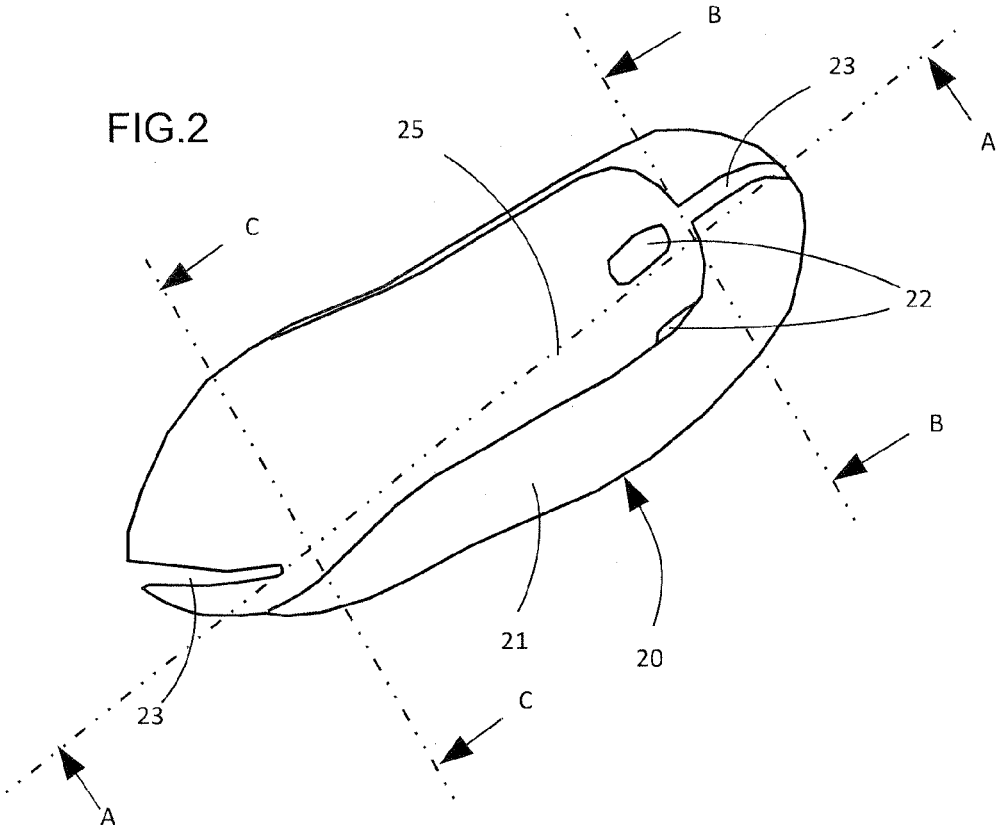
FIG. 2 is a top view in perspective of a first, thin slipper according to the embodiment of the invention.
Figure 3:
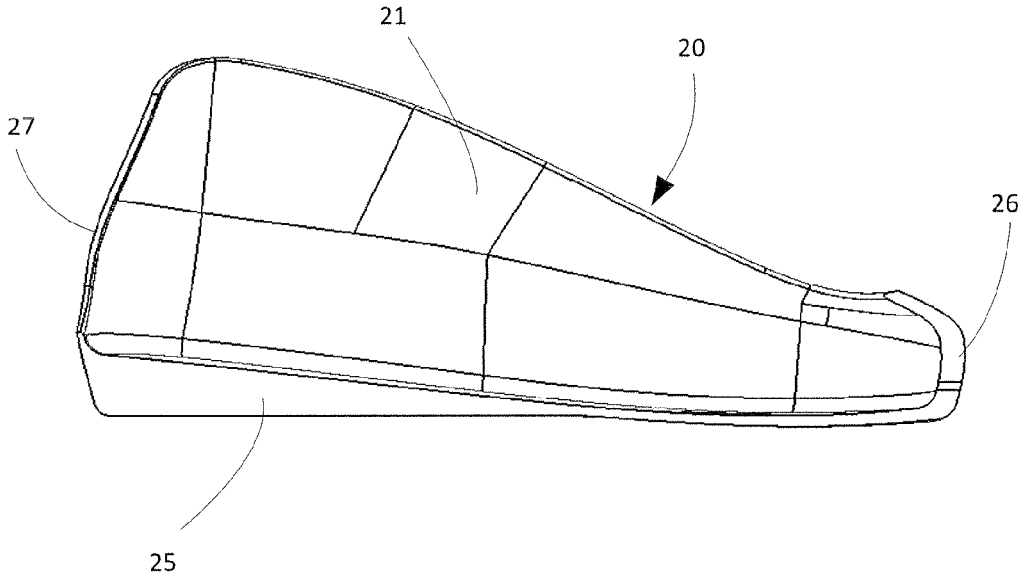
FIG. 3 is a section on A-A in a longitudinal vertical plane through the first slipper according to the embodiment of the invention.
Figure 4:
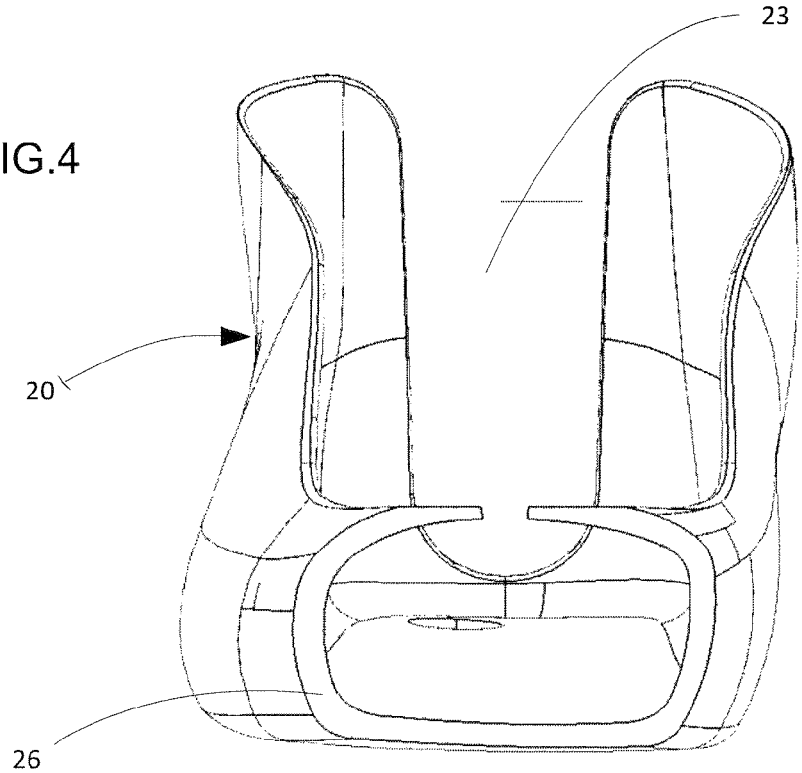
FIG. 4 is a section on B-B on a vertical transverse plane across the toes of the first slipper according to the embodiment of the invention.
Figure 5:
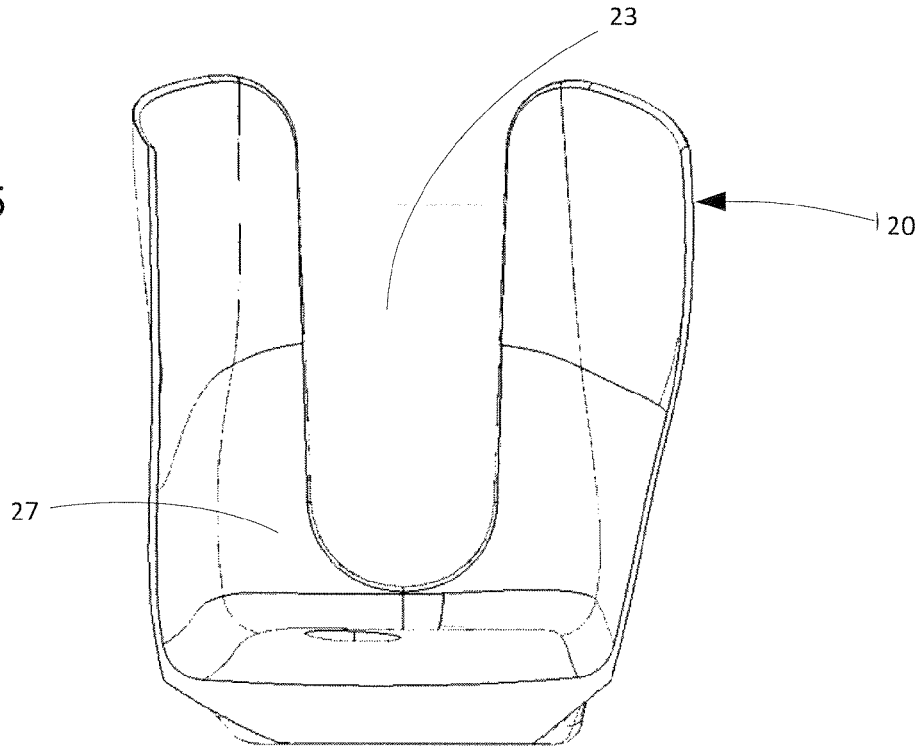
FIG. 5 is a section on C-C on a vertical transverse plane across the ankle of the first slipper according to the embodiment of the invention.
Figure 6:
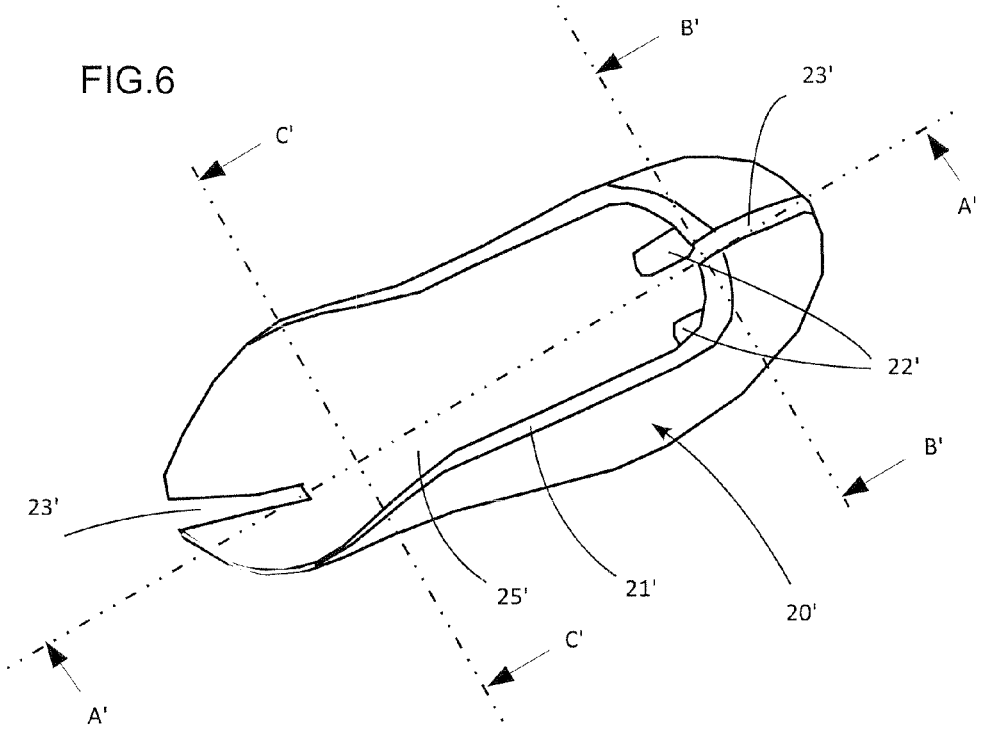
FIG. 6 is a top view in perspective of a second, thicker slipper according to the embodiment of the invention.
Figure 7:
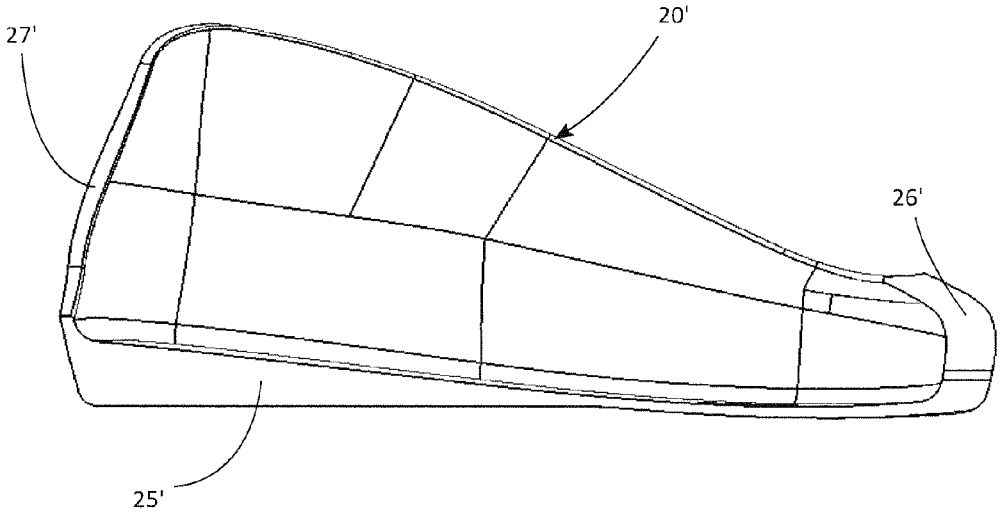
FIG. 7 is a section on A'-A' on a longitudinal vertical plane through the second slipper according to the embodiment of the invention.
Figure 8:
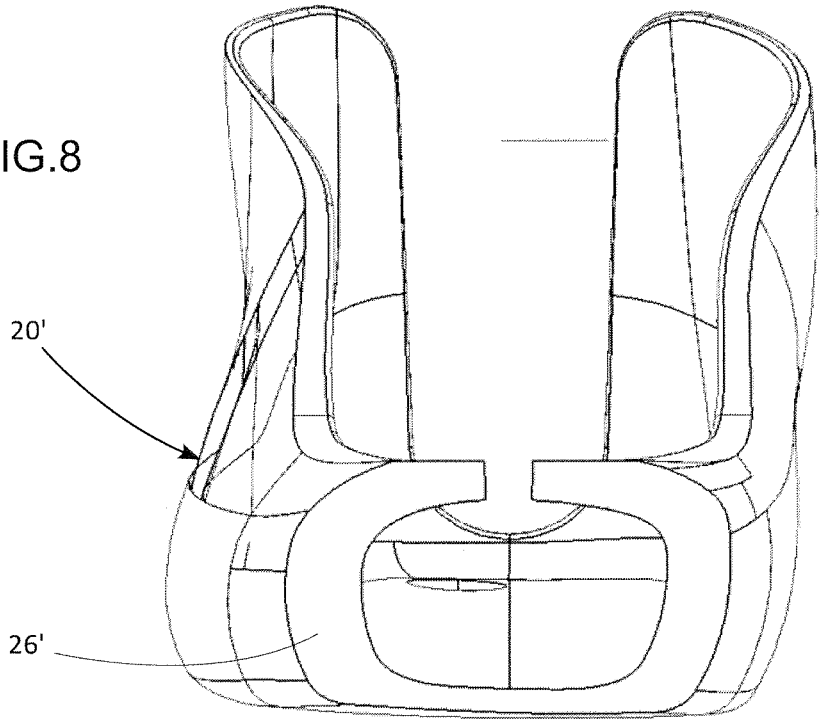
FIG. 8 is a section on B'-B' on a vertical transverse plane across the toes of the second slipper according to the embodiment of the invention.
Figure 9:
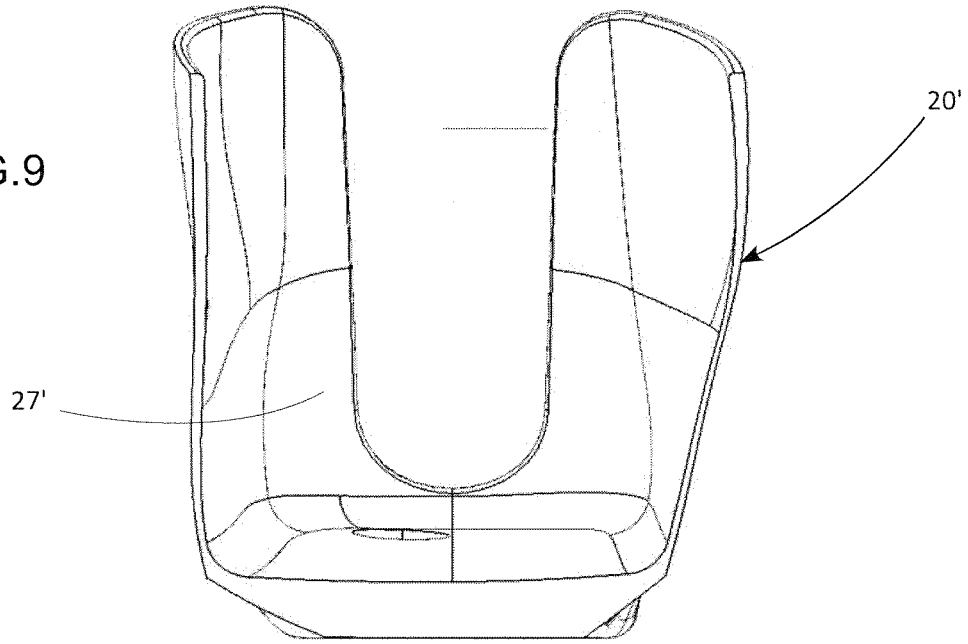
FIG. 9 is a section on C'-C' on a vertical transverse plane across the ankle of the second slipper according to the embodiment of the invention.

The invention is based on a ski boot 1 comprising the normal known components, in a form such as that illustrated in FIG. 1. It comprises a rigid shell 2, generally composed of a plastic such as polyurethane with a hardness of between 40 and 60 Shore D or any other material of equivalent stiffness, made by injection molding, enclosing the skier's foot. A rigid cuff 3, also injection molded in a material similar to that of the shell 2, is attached to the shell in such a way as to enclose the lower part of the skier's leg. These two rigid components, forming an upper, have a central division so that they can be pushed apart to ease the insertion and removal of the foot. The two flaps formed on either side of this division are connected to each other by fixing means 4 to allow these flaps to be brought together and enable the rigid boot upper formed by the combination of the shell 2 and cuff 3 to be closed and clamped. The shell also includes in its lower part a rigid bootboard 5 with standardized front and rear lips 6 to which the jaws of a ski boot binding device (not shown) are clamped. As a variant, this rigid upper, composed of the combination of the shell 2 and cuff 3, may be of any other structure, such as to form a rigid assembly, with a stiffness equivalent to that of a polyurethane with a hardness of between 40 and 60 Shore D. It may also include various sub-parts of small surface area made of a stiffer or more flexible material. This structure may in particular be made by a process of double injection molding of plastic.

The rigid shell may incorporate a bootboard, such as a bootboard generally known as a Zeppa, which is made separately and inserted into the shell, to finalize the lower part of the shell, in a well known process. This Zeppa bootboard usually has a roughly horizontal upper surface and a projecting lower part designed to be housed in a longitudinal groove formed in the shell, along the bootboard of the boot, during the injection molding process. The advantage of this manufacturing method is that it produces not only a shell of a relatively constant thickness by injection molding but also the Zeppa by a simple and inexpensive molding process, the placing of which in the shell makes possible the final formation of the larger volume of material necessary in the bottom of the shell, with the simultaneous provision of thermal insulation where the Zeppa meets the shell. A comfort innerboot 10,10' corresponding in volume to the internal volume defined by the rigid upper is then inserted into this upper, where it will accommodate the skier's foot. The comfort innerboot conforms closely to the inner surface of the rigid upper of the boot to ensure good transmission of the forces of the skier to the ski to give good control of the skis. The innerboot has a much more flexible structure than the rigid upper of the boot to give some measure of comfort to the skier whose foot and lower leg are directly in contact with the innerboot.

The invention is based on the use of a complementary component called a slipper, which is designed to be inserted into the basically conventional rigid shell of a ski boot to reduce the size of this upper. In the rest of this description of the embodiment of the invention, the word "size" will be used to denote integer sizes, the dimensions of which are standardized. However, the word "size" can have a broader meaning, which will be explained later. The insertion of a slipper into an injection-molded shell, which will here be termed the rigid outer shell, gives an assembly forming a shell with a smaller internal volume and therefore a smaller size.

This kind of shell produced by assembling a slipper into a rigid outer shell then accommodates a normal comfort innerboot, as will be detailed later. This makes it possible for a single injection-molded shell, made from a single injection mold, to be used for several different sizes of ski boot. This represents a considerable cost saving in terms of the manufacture of the series of boots, owing in part to the low cost of producing the slipper.

FIGS. 2-9 illustrate an embodiment of two slippers according to the invention. The slipper 20 in FIGS. 2-5 differs essentially from the slipper 20' of FIGS. 6-9 in having thinner walls 21. The outside volume of the two slippers is still practically identical, because they are designed to be inserted into an identical rigid outer shell produced in the same manufacturing mold. The internal volume of the slipper 20 is greater than that of the slipper 20', the two volumes and two internal dimensions of each slipper 20, 20' being defined in such a way as to reduce, by one or two boot sizes, respectively, the boot size defined initially by the rigid outer shell, following the normal standard sizes. The dimensions of the first slipper 20 are thus designed to make a certain rigid shell one size smaller, while the dimensions of the second slipper 20' are designed to make the same rigid outer shell two sizes smaller.

Applying the Mondopoint standard, the walls of the first slipper therefore have a total thickness such as to reduce the internal length of the shell by 10 millimeters, and the walls of the second slipper 20' similarly have a total thickness such as to reduce the internal length of the shell by 20 millimeters. Consequently, as shown particularly in FIGS. 3 and 7, the front wall 26, 26' of each slipper 20, 20' is designed to be thicker than the rear wall 27, 27'. However, the relative thicknesses of these walls can be modified, provided the sum of the thicknesses of the front 26, 26' and rear 27, 27' walls represent a value of one or two sizes for the first slipper 20 and for the second slipper 20', respectively. The side walls of each of the two slippers 20, 20' have a thickness preferably less than that of the front and rear walls, which decreases in the upper part and stops tangentially to the inner wall of the outer shell, forming a continuous and comfortable internal volume.

Figure 11:
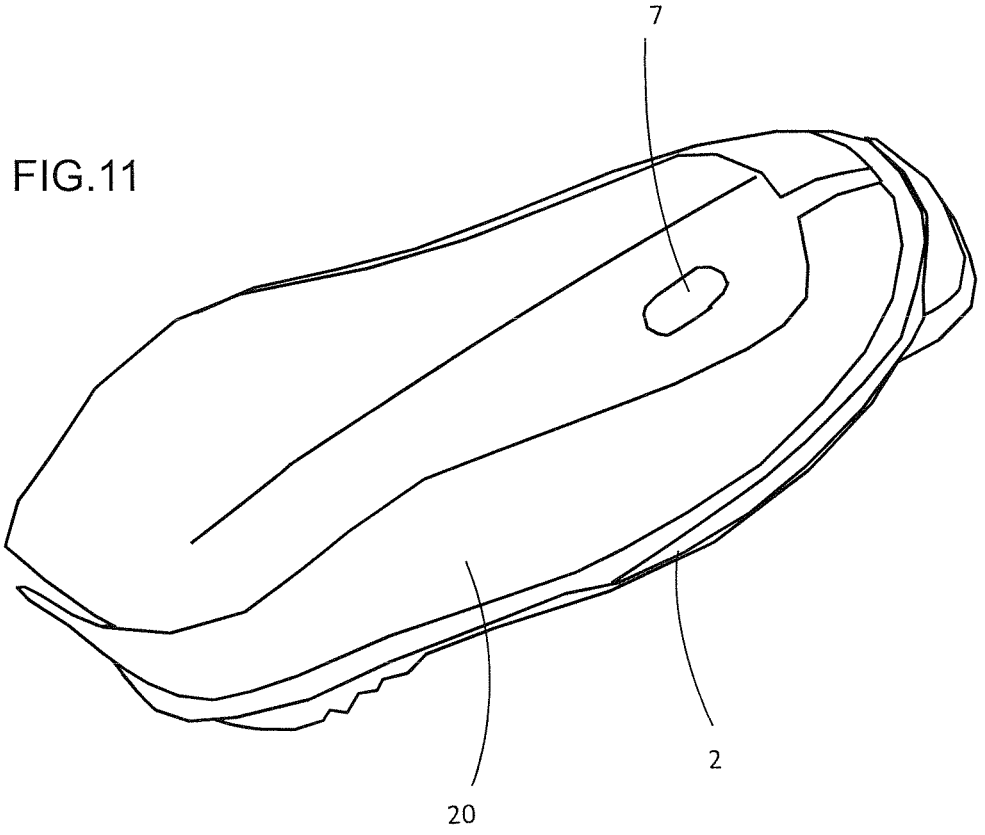
FIG. 11 is a top view in perspective of a slipper integrated into the lower part of the rigid shell of the ski boot as shown in FIG. 10 according to the embodiment of the invention.

In the embodiment shown in FIGS. 2-9, the slipper 20, 20' comprises a basically horizontal sole 25, 25' designed to take the weight of the foot, and vertical walls 21, 21' designed to at least partly enclose the skier's foot, so as to cover the toes of the foot at the front and rise as high as the ankles (i.e. ankle level) at the rear, above or below the malleoli depending on the desired precision. The slipper 20, 20' further includes two openings 22, 22' in its sole 25, 25' to facilitate its location within a shell, as illustrated with reference to FIG. 11. As a variant, any means of centering or location could be used. The slipper 20, 20' further includes an essentially vertical division 23, 23' at its front end and at its rear end to allow its walls 21, 21' to flex, thus facilitating its insertion and removal into and from a rigid ski boot shell.

Figure 10:
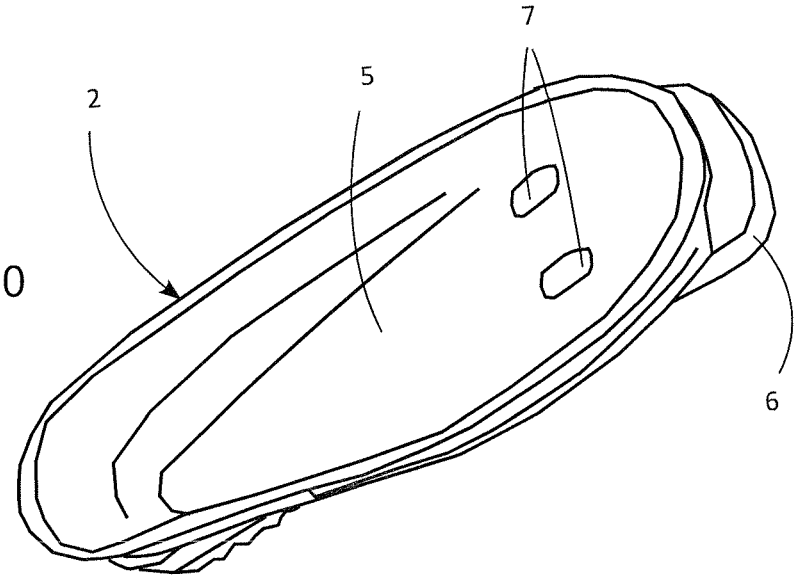
FIG. 10 is a top view in perspective in section through a lower part of a rigid shell of the ski boot according to the embodiment of the invention.

FIG. 10 illustrates by way of example the lower part of a rigid shell 2, truncated to facilitate the illustration, which is of a traditional form with a bootboard 5 forming lips 6 at its front and rear ends. According to the invention, this bootboard comprises humps 7 corresponding in shape to the openings 22, 22' in the sole 25 of the slippers 20, 20'. The latter are thus of a suitable shape for a housing in the rigid shell 2 of the boot, so that their walls 21 come into contact with the inner surfaces of the walls of the rigid shell, in an assembly illustrated in FIG. 5. The hump 7 occupies the opening 22 of the sole 25 of the slipper 20 in such a way that the slipper is located and held in position.

According to the invention, the slipper 20, 20' is made by a simple and economical manufacturing method using expanded polyurethane to obtain a semi-rigid component with a hardness of around 25 Shore D, between 20 and 30 Shore D, and with side walls less than 20 millimeters in thickness. As a variant the slipper may be made of rubber, of a recycled material, so as to obtain an equivalent hardness. The slipper is a simple shape and made of an expanded material, allowing production by a simple process employing low pressure and an inexpensive mold, especially as there is no need to obtain a clean, precise finish. This method thus results in the integration of a slipper between the rigid outer upper and the flexible innerboot, the hardness of which is intermediate between that of the rigid outer upper 2, 3 of the boot and that of the comfort innerboot 10, representing a good compromise between the desired end performance of the boot and its comfort.

A slipper such as this makes it possible to modify the boot size of a rigid boot shell when inserted into the shell, without necessitating the manufacture of a different shell, of a different size, and therefore without necessitating the use of another shell manufacturing mold thereby greatly reducing the manufacturing costs. As illustrated, several slippers 20, 20' having the same external volume but different internal volumes can be used, when inserted into a single shell, to obtain multiple boots of different sizes. With this approach, one shell can either be fitted with no slipper, or with a slipper 20 of a first size, or with a slipper 20' of a second size, so that a given rigid shell can be used to form three ski boot shells of different sizes. As a variant, more than two slippers could be used in one shell.

However, the greater the thickness of the wall of the slipper, the less the overall stiffness of the boot, and the more it will be difficult to reduce the initial volume of the shell evenly. This could reduce the performance of the boot and reduce its comfort. For this reason the use of only two slippers, with walls having a maximum thickness of approximately 10 millimeters in one case and 20 millimeters in the other, represents a good compromise and an optimal solution.

The invention also relates to a series of several boots comprising in particular a number of boots that is a multiple of three, i.e. three, six, nine and twelve ski boots, in which a given shell is used to obtain three different sizes. For this purpose, for each shell it is possible to insert either the traditional Zeppa bootboard, or a first slipper 20, or a second slipper 20' of smaller internal volume, and each slipper may or may not be connected to the Zeppa bootboard, which can optionally be incorporated into the slipper. This makes it possible to make as many as three assemblies equivalent to three different sizes of shells from a single rigid outer shell manufactured by plastic injection molding. It is thus possible for example to manufacture a series of six ski boots for Mondopoint sizes 22 to 27, from 25 to 30, or from 28 to 33. For three injection-molded shells, it is possible to obtain nine sizes, for example from 22 to 30, the smallest shell being used for sizes 22 to 24, the intermediate shell for sizes 25 to 27, and the largest shell for sizes 28 to 30. As a variant, the nine sizes may cover sizes 25 to 33. In the same way, a series of twelve sizes, from 22 to 33, may be envisioned, from four different shells. In all cases, a different comfort innerboot is inserted into each of the different resulting shells, their size corresponding to the shell defined by the optional assembly of the rigid outer shell with a slipper. The result is that no shell receives multiple innerboots of different sizes to form different integer sizes, which is an advantage. As an additional remark, one injection-molded cuff is made for each injection-molded shell, and so it is also possible to use the same number of different cuffs as the number of shells and therefore a smaller number of injection molds to obtain the different boots of the series. As a variant, it is possible to provide different cuffs for one and the same shell, such as a different cuff for each size, or the same cuff for two successive sizes, thus using for example three different cuffs for a series of six sizes of boot and therefore for two sizes of outer shell. Lastly, because the different sizes use only a small number of different shells, a series of boots requires a small number of different adjustments of a ski boot binding device, more precisely one adjustment for each rigid outer shell, which is a great advantage, as observed earlier.

Naturally, the invention is not limited to making the series of ski boots detailed above. Any other series could be envisioned, comprising the use of at least one slipper to reduce the size of an injection-molded shell to produce two different sizes from one injection-molded shell, depending on whether or not a slipper is inserted. Furthermore, the concept of the invention has been described with reference to the inexpensive manufacture of a series of boots, in order to obtain different integer sizes, according to the Mondopoint size standard. It would of course be obvious to exploit this same concept to obtain half-sizes, or sizes defined by any other standard. In particular, the same concept can be used to form different boots, of different internal widths, for example at the metatarsophalangeal articulation, in order to use one and the same shell for maximum comfort, in the case of a large width, or for greater performance, for example competition, in the case of a narrow width. Thus, the concept of the invention makes it possible to modify the internal dimension of a shell in all directions, not only its length. The term "size" is thus used here to denote the internal foot-enclosing volume offered by a boot, with reference to all directions.

The invention also relates to a method of making a ski boot shell, comprising a step of making a rigid outer shell by injection molding of a rigid plastic, which method includes a step of making a slipper, and then a step of inserting the slipper into the rigid outer shell. The step of making a slipper may consist in making it from an expandable plastic.

The invention also relates to a method of making a series of ski boots, comprising a step of making at least two identical outer shells 2 by injection molding of a rigid plastic, which method includes a step of making a slipper 20, then a step of inserting the slipper 20 into an outer shell 2, so obtaining at least two ski boot shells of different sizes and/or which method comprises a step of making two different slippers 20; 20', and then a step of inserting each slipper 20; 20' into an identical outer shell 2, so obtaining at least two ski boot shells of different sizes.

The slipper 20, 20' has been illustrated by way of example but it could have other geometries without departing from the concept of the invention. The slipper may incorporate the structure of the traditional Zeppa and be incorporated in a shell instead of the Zeppa, or not incorporate it and be added along with the Zeppa in a shell. Again, its side walls may take other shapes, greater or lesser heights, less regular around the perimeter of the foot. However, these side walls are sufficient to reduce a particular shell by at least one size when inserted, and therefore they must have a minimum surface area distributed around the periphery of a skier's foot. The side walls of the slipper thus advantageously occupy the complete perimeter of the sole, in such a way that they can completely enclose a skier's foot, or more precisely the comfort innerboot comprising the foot of a skier. This perimeter does not have to be completely continuous, and grooves, openings or any form of interruption may be provided, without however excessively interrupting the side walls which occupy at least half of the perimeter of a foot in order to perform their function. Perforating the walls is a possible way of reducing the weight and cost of the slipper. Furthermore, these walls are of sufficient height to cover the side of a foot and reach at least somewhat on to the top of the foot, in order to define a sufficient volume around the foot.

The three components of the wall of the resulting boot, i.e. the wall of the outer shell, the wall of the slipper, and the wall of the comfort innerboot, are made with dimensions such as to press against each other in order to provide a boot that performs well in the transmission of forces from the foot to the ski.

An embodiment of the invention of this kind offers equipment hire stores great flexibility. In the first place, purchasing a series of boots is much cheaper. Secondly, since the same shell can be used for a plurality of different sizes by adding a removable element, a slipper, it is much less likely to run out of a certain size because it needs only have a sufficient quantity of slippers in stock to reduce this risk.

The invention claimed is:

1. A system for a series of ski boots, comprising at least two ski boots having a same sized rigid outer shell, and in which at least one of the boots of the series of boots has the rigid outer shell comprising an internally inserted slipper, the slipper comprising a sole and side walls, so that the at least two ski boots comprising identical rigid outer shells are of different internal sizes, wherein the slipper is configured to be integrated between the rigid outer shell and an innerboot, wherein the slipper has a hardness intermediate between that of the rigid outer shell of the boot and that of the innerboot, said innerboot having a more flexible structure than that of the rigid outer shell, wherein said side walls of the slipper are configured to cover a toe of a wearer at a front end and rise to and stop at an ankle level at a rear end of the slipper, and wherein the slipper includes an essentially vertical division which is a gap in the side wall of at least at one of the front end and the rear end, wherein the at least two ski boots comprise:

a first ski boot including the innerboot in which no slipper is inserted in the rigid outer shell;

a second ski boot with the slipper inserted between the rigid outer shell and the innerboot, so that the second ski boot is one size smaller than the first ski boot.

2. The system for the series of ski boots as claimed in claim 1, wherein the slipper has a stiffness of an expanded polyurethane with a hardness of between 20 and 30 Shore D.

3. The system for the series of ski boots as claimed in claim 1, wherein the slipper is removable.

4. The system for the series of ski boots as claimed in claim 1, wherein the at least two ski boots have the same outer shell, two different sizes and comprise the same cuff or a different cuff.

5. The system for the series of ski boots as claimed in claim 4, wherein it comprises: a first ski boot comprising an outer shell, in which no slipper is inserted; a second ski boot having an outer shell identical to that of the first boot, comprising a first model of slipper inserted in this outer shell, so that this ski boot is one size smaller than the first ski boot; a third ski boot having an outer shell identical to that of the first boot, comprising a second model of slipper inserted in this outer shell, so that this ski boot is two sizes smaller than the first ski boot.

6. The system for the series of ski boots as claimed in claim 5, wherein the three ski boots with the same outer shell and three different sizes comprise a different comfort innerboot, its volume being such that its walls fit the inside wall of the boot shell.

7. The system for the series of ski boots as claimed in claim 4, wherein it comprises six boots of different integer sizes obtained with two different outer shells and at least two different slippers per outer shell.

8. The system for the series of ski boots of claim 1 wherein the at least two ski boots comprise: the first ski boot comprising the outer shell, in which no slipper is inserted; the second ski boot having the outer shell identical to that of the first boot, comprising a first model of the slipper inserted into this outer shell, so that this ski boot is one size smaller than the first ski boot; and a third ski boot having an outer shell identical to that of the first boot, comprising a second model of the slipper inserted into this outer shell, so that this ski boot is two sizes smaller than the first ski boot, wherein the slipper is configured to be integrated between the outer shell and an innerboot of the ski boot.

9. The system for the series of ski boots of claim 1 wherein a wall of the slipper has a thickness selected from 10 mm or 20 mm.

10. The system for the series of ski boots of claim 1 wherein the slipper comprises a sole including two openings configured to facilitate the slipper's placement within the rigid outer shell; and the rigid outer shell comprises a bootboard including a plurality of humps corresponding in shape to the two openings of the slipper, wherein each of the humps occupy each of the openings of the slipper's sole so as to locate and hold the slipper in position.

11. The system for the series of ski boots of claim 1, wherein the side walls of the slipper have a thickness less than that of front and rear walls.

12. The system for the series of ski boots of claim 1, wherein a front wall of the slipper is thicker than a rear wall of the slipper.

13. The system for the series of ski boots of claim 1, wherein the side walls of the slipper have a thickness which decreases in a upper part of the slipper and stops tangentially to an inner wall of the rigid outer shell, forming a continuous internal volume for the boot.

14. The system for the series of ski boots as claimed in claim 1, further comprising a boot with a first slipper and a boot with a second slipper, an outside volume of the two slippers being still practically identical and an internal volume of the first slipper is greater than that of the second slipper.

15. The system for the series of ski boots as claimed in claim 1, further comprising a boot with a first slipper, walls of the first slipper having a total thickness such as to reduce an internal length of the rigid shell by 10 millimeters, such that a size of the ski boot is reduced by one size.

16. The system for the series of ski boots as claimed in claim 13, further comprising a boot with a second slipper, the walls of the second slipper having a total thickness such as to reduce an internal length of the rigid shell by 20 millimeters, such that a size of the ski boot is reduced by two sizes.

* * * * *